United States Patent [19]

Krogstad et al.

[11] 4,214,545

[45] Jul. 29, 1980

[54] ANCHOR STOWING ARRANGEMENT

[75] Inventors: Ivar Krogstad, Arendal; Harry S. Sandøy, Kolbjørnsvik; Thor O. Haavie, Oslo, all of Norway

[73] Assignee: A/S Pusnes Mekaniske Verksted, Arendal, Norway

[21] Appl. No.: 912,867

[22] Filed: Jun. 5, 1978

[30] Foreign Application Priority Data

Jun. 6, 1977 [NO] Norway ..... 771972
Apr. 19, 1978 [NO] Norway ..... 781379

[51] Int. Cl.[2] ..... B63B 21/24
[52] U.S. Cl. ..... 114/294
[58] Field of Search ..... 114/210, 293, 294, 302, 114/230, 310, 179

[56] References Cited

U.S. PATENT DOCUMENTS

| | | | |
|---|---|---|---|
| 1,158,160 | 10/1915 | Fravenfelder | 114/210 |
| 3,554,153 | 1/1971 | Davis | 114/210 |
| 3,774,562 | 11/1973 | Dean | 114/293 |
| 3,841,606 | 10/1974 | Declercq | 114/218 |
| 3,886,882 | 6/1975 | Thornburg et al. | 114/179 |

*Primary Examiner*—Trygve M. Blix
*Assistant Examiner*—Jesus D. Sotelo
*Attorney, Agent, or Firm*—Stanley B. Kita

[57] ABSTRACT

An anchor is stowed entirely within a recess in the bottom of a vessel, by means of a fairlead within the recess comprising a sheave supported in a bracket pivotable about a vertical axis in the center of the recess, along which axis the pull of the anchor winch occurs; the bracket has a hollow space for receiving the shank of the anchor, and a spring-based roller holds the anchor line against the sheave. The lower part of the bracket has guide edges extending completely around the pivot axis except for a side portion corresponding to the width of the sheave for automatically guiding the anchor line onto the sheave.

5 Claims, 3 Drawing Figures

3'
3
A
8
9
5
6
12
1
4
11
10'
10
7
2'''
2
2''
2'
A

ANCHOR STOWING ARRANGEMENT

The present invention relates to an anchor stowing arrangement in a vessel, comprising a recess in the bottom of the vessel into which the anchor may be pulled.

Floating drilling rigs, auxiliary vessels for drilling and production rigs for oil, and auxiliary vessels for other offshore activities may usually be anchored to the sea bottom by means of anchor lines which can be wire rope, fibre rope, chain or combinations of these. Such floating drilling rigs or auxiliary vessels may be ships or semisubmersible vessels comprising two or more pontoons connected to a common deck by means of vertical columns.

Each anchor line is usually led through a fairlead comprising a sheave which is supported in a swiveling bracket, and in the anchoring situation this fairlead may be above or below the water surface. The fairlead is usually located in the ship's side or, in the case of semisubmersible vessels, on one of its columns.

In order to protect the hull from the anchor line and for stowing the anchors when these are hoisted, it is customary to arrange so-called "anchor racks" on the vessel. This is a rib structure, often made of pipe, placed under the fairlead. These anchor racks usually will project beyond the width or length of the remaining part of the vessel. Due to their exposed position, the anchor racks are very prone to damage.

Especially in the case of auxiliary vessels it is often desirable that other vessels be able to come all the way up to these while they are anchored. However, the anchor lines represent a great hindrance in this respect. Even though the fairleads may be placed so low that the anchor lines extend out from the auxiliary vessel under water, the draft of the auxiliary vessel may vary, and since the anchor lines are not visible they can represent an even greater danger for other vessels wishing to come up to the auxiliary vessel.

Anchor racks and fairleads also represent hindrances for other vessels wishing to moore along the auxiliary vessel and may prevent the auxiliary vessel from mooring close to an offshore structure or quay.

In order to eliminate some of these drawbacks, on some auxiliary vessels the anchor racks and fairleads have been arranged so that they lie inside the width of the vessel. However, this restricts the swiveling angle of the fairlead. Concurrently, problems occur when the anchor racks must function as stowage place for other than very special anchors. Furthermore, the anchor racks will not protect the hull against wear from the anchor lines.

In addition, there is previously known a mooring system for drill ships of the so-called "turret type" in which a middle cylindrical portion of the ship may be turned about a vertical axis. The drilling tower and a number of anchoring winches are all mounted on this cylindrical portion. The mooring lines are each led vertically down to a fixed sheave at the bottom of the cylindrical portion. When current and wind change direction, the ship is rotated about the cylindrical portion by means of common anchoring winches forward and aft. The anchors cannot be stowed in the cylindrical portion but must be taken on board the ship or on board separate auxiliary vessels. Such a system may neither be used for vessels of a generally rectangular shape having need for anchoring at least in each corner.

The purpose of the invention is to provide an anchoring system, preferably for vessels of the type mentioned by way of introduction, where the above noted deficiencies and drawbacks are avoided. This is obtained according to the invention by an anchor stowing arrangement of the type comprising a recess in the bottom of the vessel into which the anchor may be pulled, where the characteristic features are that a fairlead for the anchor line is arranged in the recess. Hereby the anchor line is held so far below the water line that there is no danger of conflict with vessels wishing to moor alongside. Neither can there be any conflict between the fairlead guiding the anchor line and other vessels. Furthermore, the need for anchor racks is eliminated and, in addition, it becomes possible to stow the anchor in a simple and effective manner.

In several applications it is desirable to be able to lead the anchor line out in all directions from the vessel, preferably 360°, and in an especially suitable embodiment, the fairlead has the form of a roller fairlead with one or more alternative sheaves for bending of the anchor line, said sheaves being supported in brackets which are pivotable about an axis approximately coinciding with the anchor line pull in the direction of the anchor winch, said axis approximately coinciding with the axis of the recess.

Further advantagous features of the invention will be apparent from the claims and the following description of the examplifying embodiments shown in the drawing.

Figure 1:
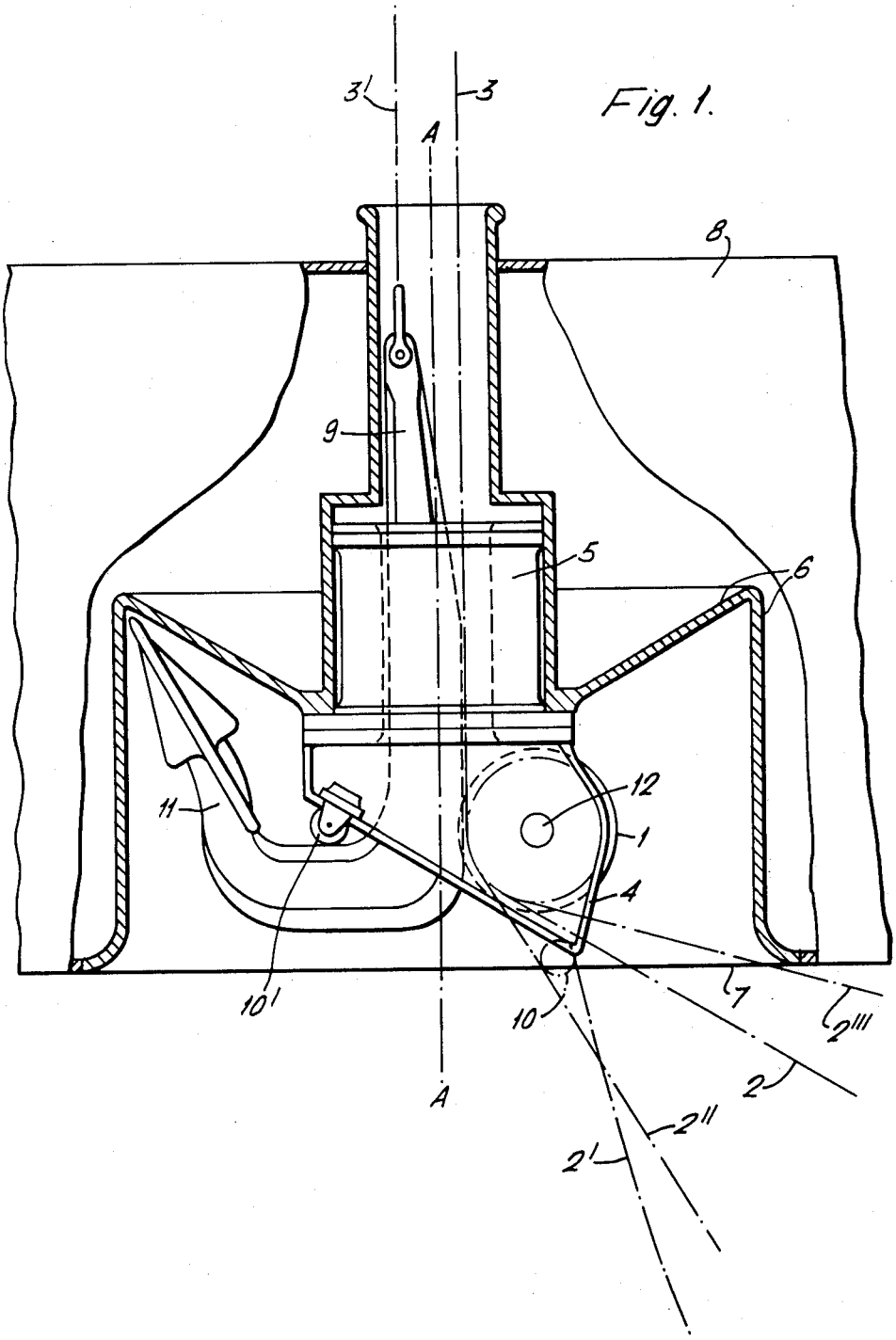
FIG. 1 shows a side elevation, partly in section, of a section of a vessel equipped with an anchor stowing arrangement according to the invention.

In the embodiment shown in FIG. 1, the vessel, which in this case is a semi-submersible structure, is shown by the pontoon 8. In the bottom 7 of the pontoon a recess 6 is arranged, the recess being symmetrical about a vertical axis A—A. In the recess 6 is arranged a roller fairlead comprising a stationary part 5 and a pivotable bracket 4 with a sheave 1, said bracket being mounted so that its pivot axis corresponds with the axis A—A. The sheave 1 is rotatable about an axle 12 supported in the bracket 4. The sheave 1 is placed so low in the recess 6 that an anchor line 2 may extend outwards with an angle of as little as about 15° with the horizontal without coming into contact with the bottom 7 of the vessel. This position of the anchor line is indicated with 2'''. On the upper side of the sheave 1 the anchor line continues as indicated by 3 or 3' to an anchor winch (not shown).

When the anchor line is rather slack, as indicated by 2', it is pressed against the sheave 1 by means of a roller 10 which in the active position is shown in broken line. The roller 10 is spring biased so that it may be forced back when the anchor line is subjected to tension. The spring bias may be replaced by i.a. a pendulum suspension, and in this case the bottom part of the bracket 4 is removed and the roller 10 is moved further down. The purpose of forcing the roller 10 against the sheave 1 when the line 2' is slack is to give the force from the line sufficient moment arm to swing the bracket 4.

As shown, the shank 9 and the flukes 11 of the anchor may be stowed in the recess. If necessary, the anchor is concurrently turned so that its flukes 11 fall outside the area occupied by the sheave 1. Such a rotation may be brought about automatically by forming the sheave 1 and/or the bracket 4 and/or the anchor 9, 11 in such a fashion that the flukes swing to the desired sector of the recess when the anchor enters the fairlead.

Figure 3:
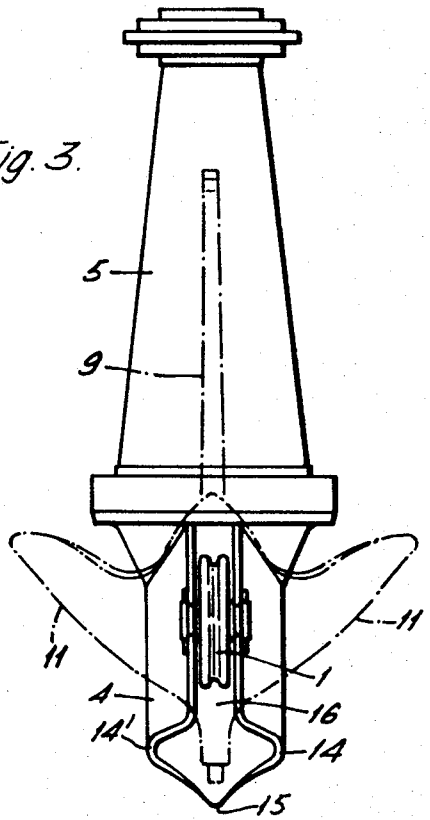
FIG. 3 shows a part of the anchor stowing arrangement of FIG. 2 seen in the direction of the arrow III.
Figure 2:
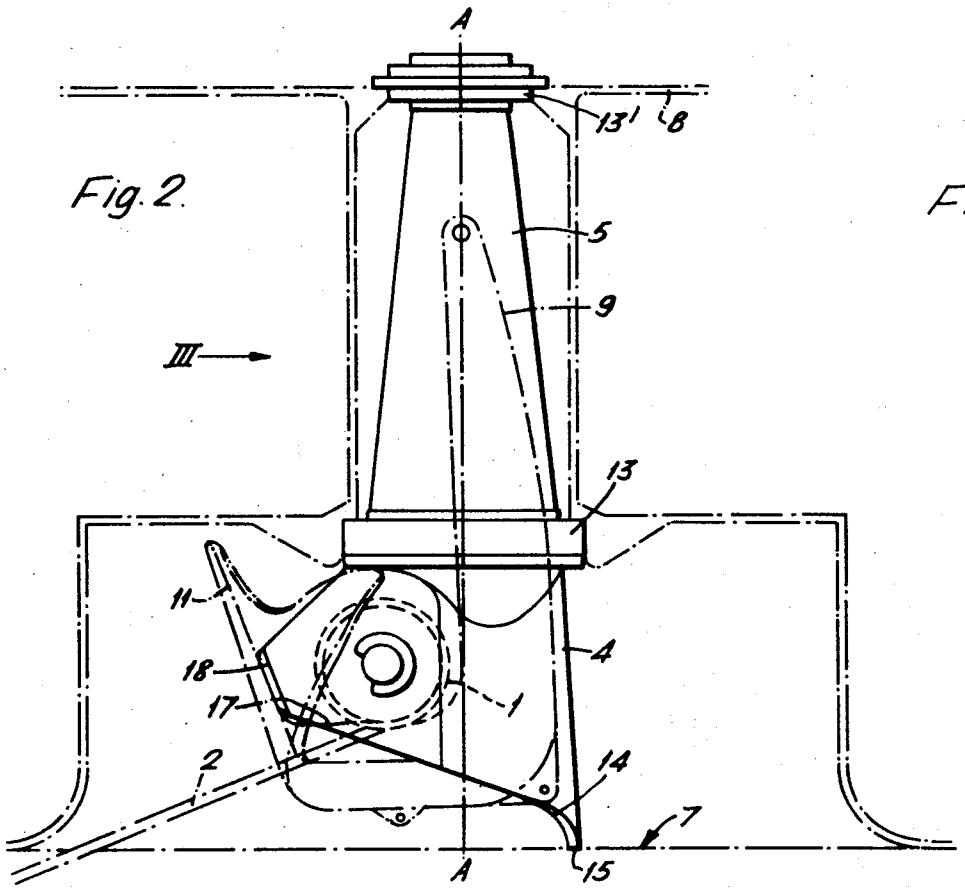
FIG. 2 shows a section like FIG. 1 of an alternative embodiment of the anchor stowing arrangement.

FIGS. 2 and 3 show an example of such a cooperating form of anchor and bracket.

In this case both the bracket 4 and the part 5 of the roller fairlead are rotatably supported by means of bearing 13, 13'. Here, the bracket 4 has an enveloping configuration and surrounds the axis A—A except from an area 16 covered by the width of the sheave 1. At the bottom the bracket 4 terminates in guide edges 14, 14' running in an upward direction from a lower point 15 to the opening 16 for the sheave 1 in the bracket. The guide edges 14, 14' may each advantageously form part of an helix.

When the anchor is put out and the line 2 is tensioned, the line most probably does not come into contact with the sheave 1 right away but will bear against some point on one of the guide edges 14, 14'. If the slope of the guide edges is sufficiently steep the line 2 will slide upwards along the edge while the bracket 4 and the upper part 5 rotate until the line finds its place in the sheave 1. Here it will lie as long as it is subjected to tension because the resultant of the forces transmitted to the sheave 1 attacks in a point lying eccentrically in the pull direction with respect to the axis A—A.

When the anchor is to be stowed there is little likelyhood that it will hit correctly right away. However, the surface or ridge 17 of the anchor will strike against one of the guide edges 14, 14' and slide upwards along this edge while a relative rotation takes place between the anchor and the bracket 4, and the anchor will come to rest in the desired position shown in the figures when the hauling in is finished. The internal hollow space in the bracket 4 and the upper part 5 must of course be dimensioned so that the necessary turning of the shank 9 of the anchor can take place unobstructed. The edges of the bracket 4 defining the opening 16 are equipped with buffers 18 preferably consisting of elastomeric material and adapted to the dimensions of the anchor in use.

As will be apparent from the figures, the fairlead is placed in its entirety inside the bottom of the vessel. This is also the case for the anchor in stowed position. Hereby neither the fairlead nor the anchor will hinder docking of the vessel.

The invention also gives the possibility of using the anchor lines of the vessel for hoisting objects from the bottom. The hoisting may take place by means of anchor winches or changes in the buoyancy of the vessel.

We claim:

1. An arrangement for stowing an anchor having a shank and flukes in a vessel, of the type employing a recess in the bottom of the vessel into which the anchor may be pulled by an anchor winch on the vessel, comprising:

a fairlead arranged in said recess for receiving the anchor line and anchor shank;

said fairlead comprising a roller fairlead having at least one sheave for bending of the anchor line, a bracket for supporting said at least one sheave, said bracket being pivotable about a pivot axis approximately coinciding with the direction of pull on the anchor line by the anchor winch, said pivot axis generally coinciding with the axis of said recess;

the lower part of said bracket being provided with guide edges extending entirely around said pivot axis except for an area corresponding to the width of said at least one sheave, said guide edges extending from the lower point thereof upward to said area, said fairlead having transverse and lengthwise dimensions sized to receive the anchor shank and to permit the anchor shank to be drawn upwardly into the fairlead until the anchor flukes engage said guide edges, said guide edges cooperating with the anchor flukes upon further upward movement of the anchor to cause relative rotation between the anchor shank and the bracket for orienting the anchor in the recess in said vessel.

2. An arrangement according to claim 1, wherein each of said guide edges is substantially in the form of a part of a helix.

3. An arrangement according to claim 2, wherein said fairlead lies entirely inside the bottom of said vessel.

4. An arrangement according to claim 1, wherein said bracket has an internal hollow space for receiving the shank of said anchor.

5. An arrangement according to claim 4, comprising a spring-biased roller for biasing said anchor line against said sheave, said roller being movable away from said sheave to a position out of the way of said shank of said anchor when the latter is stowed in said recess.

* * * * *